US008550939B2

(12) United States Patent
Ueda et al.

(10) Patent No.: US 8,550,939 B2
(45) Date of Patent: Oct. 8, 2013

(54) METHOD FOR EVALUATING HIT FEELING

(75) Inventors: Naoyoshi Ueda, Kobe (JP); Masahiko Ueda, Kobe (JP); Takeshi Asakura, Kobe (JP)

(73) Assignees: SRI Sports Limited, Kobe (JP); Sumitomo Rubber Industries, Ltd., Kobe (JP)

( * ) Notice: Subject to any disclaimer, the term of this patent is extended or adjusted under 35 U.S.C. 154(b) by 220 days.

(21) Appl. No.: 12/953,547

(22) Filed: Nov. 24, 2010

(65) Prior Publication Data

US 2011/0124440 A1 May 26, 2011

(30) Foreign Application Priority Data

Nov. 25, 2009 (JP) ..... 2009-267364

(51) Int. Cl.
*A63B 69/36* (2006.01)

(52) U.S. Cl.
USPC ..... 473/409

(58) Field of Classification Search
USPC ..... 473/221, 223, 409
See application file for complete search history.

(56) References Cited

U.S. PATENT DOCUMENTS

| | | | | |
|---|---|---|---|---|
| 6,441,745 | B1 * | 8/2002 | Gates | 340/669 |
| 7,308,818 | B2 * | 12/2007 | Considine et al. | 73/12.09 |
| 7,870,790 | B2 * | 1/2011 | Sato et al. | 73/579 |
| 2002/0077189 | A1 * | 6/2002 | Tuer et al. | 473/151 |
| 2005/0215340 | A1 * | 9/2005 | Stites et al. | 473/233 |
| 2005/0261073 | A1 * | 11/2005 | Farrington et al. | 473/221 |
| 2006/0025229 | A1 * | 2/2006 | Mahajan et al. | 473/131 |
| 2006/0184336 | A1 * | 8/2006 | Kolen | 702/150 |
| 2008/0115582 | A1 * | 5/2008 | Sato et al. | 73/649 |
| 2009/0088275 | A1 * | 4/2009 | Solheim et al. | 473/409 |
| 2009/0143159 | A1 * | 6/2009 | Murph et al. | 473/239 |
| 2010/0093463 | A1 * | 4/2010 | Davenport et al. | 473/342 |
| 2010/0304877 | A1 * | 12/2010 | Iwahashi et al. | 473/223 |
| 2011/0028248 | A1 * | 2/2011 | Ueda | 473/409 |
| 2011/0086720 | A1 * | 4/2011 | Jaekel et al. | 473/223 |
| 2011/0124440 | A1 * | 5/2011 | Ueda et al. | 473/409 |
| 2011/0130223 | A1 * | 6/2011 | Murdock et al. | 473/409 |
| 2012/0214606 | A1 * | 8/2012 | Ueda | 473/199 |

FOREIGN PATENT DOCUMENTS

| | | | |
|---|---|---|---|
| JP | 2001-246028 | A | 9/2001 |
| JP | 2002-286565 | A | 10/2002 |
| JP | 2005-292061 | A | 10/2005 |
| JP | 2008-125722 | A | 6/2008 |

* cited by examiner

*Primary Examiner* — Raleigh W Chiu
(74) *Attorney, Agent, or Firm* — Birch, Stewart, Kolasch & Birch, LLP

(57) ABSTRACT

A valuation method of the present invention quantitatively estimates hit feeling of a sport hitting tool. The evaluation method includes: a first step of using a measuring means M1 capable of measuring forces F acting between a swing subject and the sport hitting tool or specific directional components F1 thereof to obtain values of the forces F or the components F1 at times after impact; and a second step of deciding the hit feeling based on the value of the force F or the component F1 at at least one of the times. Preferably, the values of the forces F or the components F1 in a specified period Z12 between a time T1 and a time T2 after the impact are obtained in time series in the first step. Preferably, the hit feeling is evaluated based on an integrated value Sf of the forces F or the components F1 in the specified period Z12 in the second step.

11 Claims, 29 Drawing Sheets

METHOD FOR EVALUATING HIT FEELING

The application claims priority on Patent Application No. 2009-267364 filed in JAPAN on Nov. 25, 2009, the entire contents of which are hereby incorporated by reference.

BACKGROUND OF THE INVENTION

1. Field of the Invention

The present invention relates to a method for evaluating hit feeling of a sport hitting tool.

2. Description of the Related Art

Many sport hitting tools such as a golf club, a tennis racket, a badminton racket, a pingpong racket, and a baseball bat are used.

Hit feeling exists in these sport hitting tools. In the case of a sport requiring hitting a ball, the hit feeling is also referred to as hitting ball feeling. The hit feeling is an important element for selecting the sport hitting tool. The hit feeling exhibits conformity of the sport hitting tool to a user. The hit feeling tends to correlate with a result. The sport hitting tool having good hit feeling tends to cause a result preferred by the user. The hit feeling is an extremely important element of the sport hitting tool.

Japanese Patent Application Laid-Open No. 2002-286565 discloses a method for measuring an impact force. The impact force may correlate with hit feeling. Japanese Patent Application Laid-Open No. 2008-125722 (US2008/115582) discloses a method for measuring vibration in a circumferential direction of a shaft to evaluate hit feeling.

SUMMARY OF THE INVENTION

It is difficult to evaluate the hit feeling. The impact force is a force acting on the golf club. The vibration of the shaft is the behavior of the golf club itself. The impact force and the shaft behavior are information not associated with a human being. The present inventors considered that the evaluation of the hit feeling sensed by the human being requires measurement of information associated with the human being. As a result, the present inventors found a method for evaluating hit feeling with higher reliability.

It is an object of the present invention to provide a novel valuation method enabling quantification of hit feeling.

An evaluation method of the present invention quantitatively evaluates hit feeling of a sport hitting tool. The method includes: a first step of using a measuring means M1 capable of measuring forces F acting between a swing subject and the sport hitting tool or specific directional components F1 thereof to obtain values of the forces F or the components F1 at times after impact; and a second step of deciding the hit feeling based on the value of the force F or the component F1 at at least one of the times.

Preferably, in the first step, the values of the forces F or the components F1 in a specified period between a time T1 and a time T2 after the impact are obtained in time series The hit feeling is evaluated based on an integrated value Sf of the forces F or the components F1 in the specified period in the second step.

Preferably, the hit feeling is evaluated based on a rate Rd of change of the forces F or the components F1 in the specified period Z12 in the second step.

Preferably, the time T1 is a time Tmin when the forces F or the components F1 reach a minimum in a predetermined period.

A time when the forces F or the components F1 reach the maximum between an impact time Tp and 50 msec after the impact time Tp is defined as Tmax, and the time Tmin is a time when the forces F or the components F1 reach the minimum between the impact time Tp and the time Tmax.

Preferably, the measuring means M1 includes a pressure sensor provided between the swing subject and the sport hitting tool. Preferably, a setting position of the pressure sensor is determined based on comparison of a distribution of the forces F or the components F1 in a practice swing with a distribution of the forces F or the components F1 in actual hitting.

Preferably, in the first step the measured data is sifted through in consideration of uniformity of a swing speed and/or uniformity of a hitting point.

Preferably, the specified period is equal to or less than 100 msec.

The evaluation method according to the present invention can quantitatively evaluate the hit feeling.

DESCRIPTION OF THE PREFERRED EMBODIMENTS

Hereinafter, the present invention will be described below in detail based on preferred embodiments with reference to the drawings.

The present invention measures neither behavior of a sport hitting tool nor an impact force received by a hitting ball. The present invention measures a force F acting between a swing subject and the sport hitting tool or a specific directional component F1 thereof. The specific directional component F1 is a component of the force F. The direction of the component F1 is not limited. That is, the term "specific directional" means all directions.

In the present invention, it was found that the force F or the component F1 correlates with hit feeling.

A measuring means M1 having a sensor is used for measuring the force F or the component F1. The sensor is provided between the sport hitting tool and the swing subject.

Examples of the sport hitting tool include a golf club, a tennis racket, a badminton racket, a pingpong racket, a baseball bat, a cricket bat, and a gateball stick, but not limited thereto. Hereinafter, the following description concerns a golf club as an example.

A human being and a swing robot are exemplified as the swing subject. Since the hit feeling is sensed by the human being, the swing subject is the human being in this respect. However, the swing robot may be effective. For example, when the sport hitting tool has universal hit feeling common to a number of people, the swing robot is effective for evaluating the hit feeling of the sport hitting tool. Since the swing robot has less variation for each swing, the swing robot is effective for capturing the universal hit feeling. Hereinafter, the case where the swing subject is the human being will be mainly explained.

Figure 1:
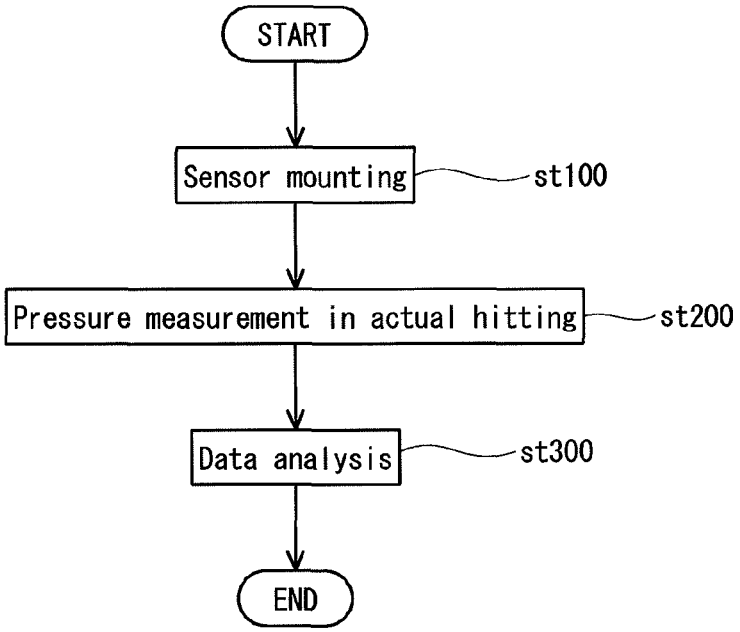
FIG. 1 is a flow chart for explaining an evaluation method according to an embodiment of the present invention.
Figure 2:
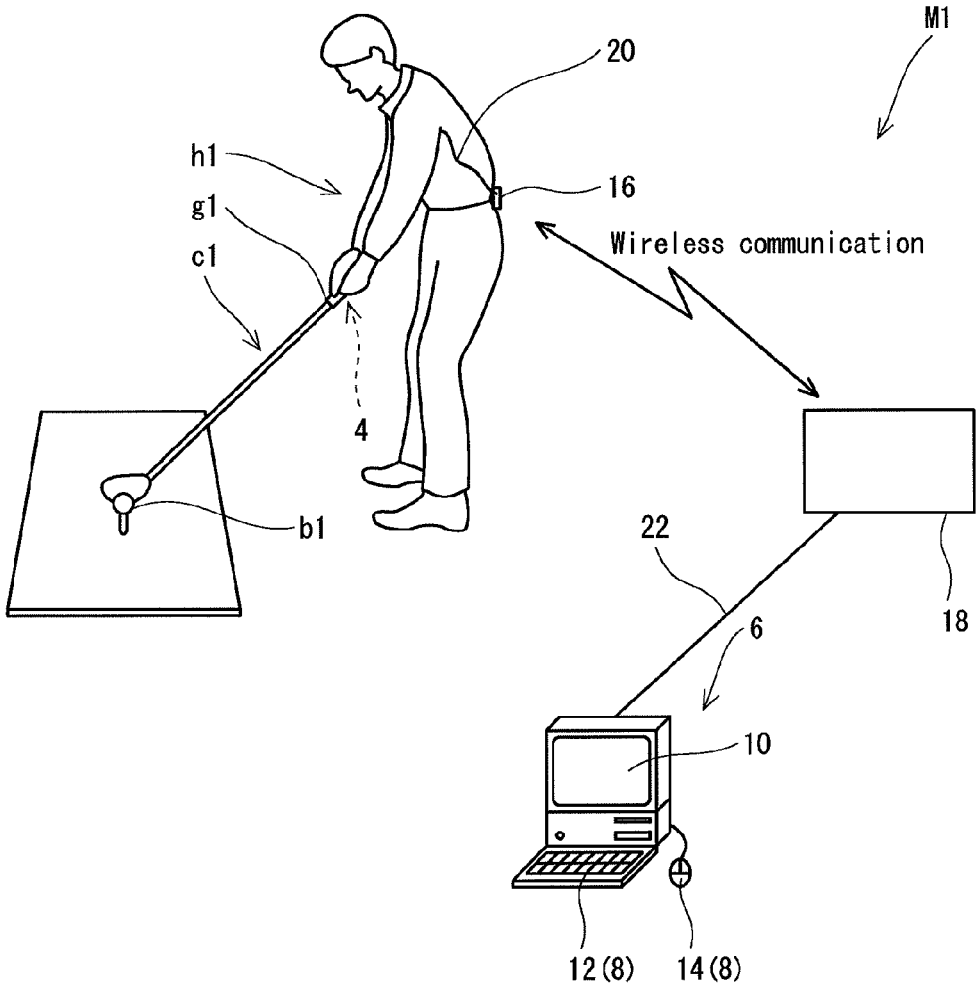
FIG. 2 is a diagram showing the evaluation method of the embodiment of the present invention.

FIG. 1 is a flow chart for showing a procedure of measurement according to an embodiment of the present invention. FIG. 2 is a diagram showing a condition of the measurement of the embodiment. In the measurement, a measuring means M1 has a sensor. The sensor 4 is mounted to the swing subject (step st100). A swing subject h1 of the embodiment is a human body. The sensor 4 is disposed on a palm of the swing subject h1. More specifically, the sensor 4 is disposed on a palm part of a glove worn by the swing subject h1. The sensor 4 may also be directly provided on the skin of the human body, or the sensor may be provided on a sport hitting tool c1.

The sensor 4 of the embodiment is a pressure sensor. When the swing subject is the human being, the sensor is mounted to the palm side or the grip side of the golf club. In the embodiment, the glove is worn by a person, and the sensor is mounted to the glove. The sensor is mounted to a contact surface between the swing subject h1 and a grip g1. A sheet-like pressure sensor is used as a preferable pressure sensor. The sheet-like pressure sensor does not obstruct a swing.

Next, a pressure in actual hitting is measured (step st200). In the present application, the term "actual hitting" means swinging to hit a ball b1. The concept of the "actual hitting" is in contrast to that of a "practice swing". The "practice swing" is a swing in which the ball b1 is not hit. The "actual hitting" is a swing in which the ball b1 is hit.

Next, data analysis is carried out (step st300). The data analysis is carried out by an arithmetic processing unit 6. The details of the analysis will be described later.

The measuring means M1 has the pressure sensor 4 and the arithmetic processing unit 6. A computer is exemplified as the arithmetic processing unit 6. The typical arithmetic processing unit 6 is provided with an operation input part 8, a data input part, a display part 10, a hard disk, a memory, and a CPU. The operation input part 8 has a keyboard 12 and a mouse 14.

The data input part is provided with, for example, an interface board for inputting A/D-converted digital data. Data input to the data input part is output to the CPU. The display part 10 is, for example, a display. The display part can display various data while the display part is controlled by the CPU.

For example, the CPU reads a program stored in the hard disk, develops the program in a working area of the memory and executes various processings according to the program. The memory, which is, for example, a rewritable memory, constitutes a storage area and a working area or the like for the program read from the hard disk and input data or the like. The hard disk stores a program and data or the like required for data processing or the like. The program makes the CPU execute required data processing. An example of the data processing is calculation of an integrated value Sf including an increasing amount Psum which will be described later, or the like. Another example of the data processing is calculation of a rate Rd of change.

Pressure data is obtained by the sensor 4. The pressure data can be obtained as time-series data. For example, the pressure data for partial or the entire time during a swing can be obtained in time series. The time-series data is, for example, a set of data obtained at regular time intervals. A change in a grip pressure during the swing can be measured by the time-series data. The display part 10 can display the time-series data as a graph or the like. A graph of the time-series data will be described later.

Figure 3:
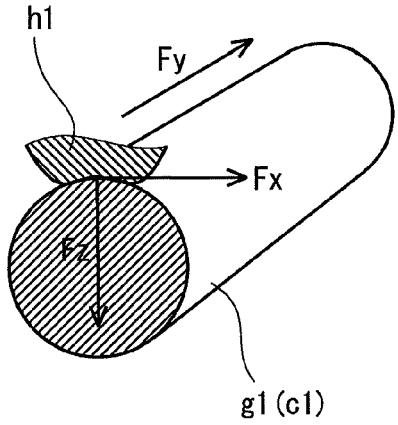
FIG. 3 is a diagram for explaining a force applied to a sport hitting tool by a swing subject.

FIG. 3 is a diagram for explaining a measured force. A hatching part h1 in FIG. 3 is a part of a cross section of a hand of the human body. As shown in FIG. 3, the force F applied to the sport hitting tool c1 by the swing subject h1 can be decomposed to a component Fx, a component Fy, and a component Fz. In the embodiment, the force Fz vertically pressing the sport hitting tool c1 is measured. The component F1 in the embodiment is the component Fz. The component F1 is not limited, and, for example, may be the component Fx or the component Fy. In the embodiment, the component Fz is measured by the pressure sensor 4.

The measuring means M1 has a wireless transmitter device 16 and a wireless receiver device 18. The wireless transmitter device 16 and the sensor 4 are connected with each other by wiring 20. The wireless receiver device 18 and the arithmetic processing unit 6 are connected with each other by wiring 22.

Data measured by the sensor 4 is sent to the wireless transmitter device 16. The wireless transmitter device 16 transmits the data and the wireless receiver device 18 receives the data. For example, Bluetooth can be suitably used as a wireless communication system. The wireless receiver device 18 is provided with a wireless antenna, a wireless interface, a CPU, and a network interface.

Wires obstructing the swing are not used by using wireless communication, and thereby the swing subject h1 can carry out an original swing. Since the use of the wireless communication achieves a natural swing, the measurement precision of the swing can be enhanced. Wired communication may be used in place of the wireless communication.

Figure 4:
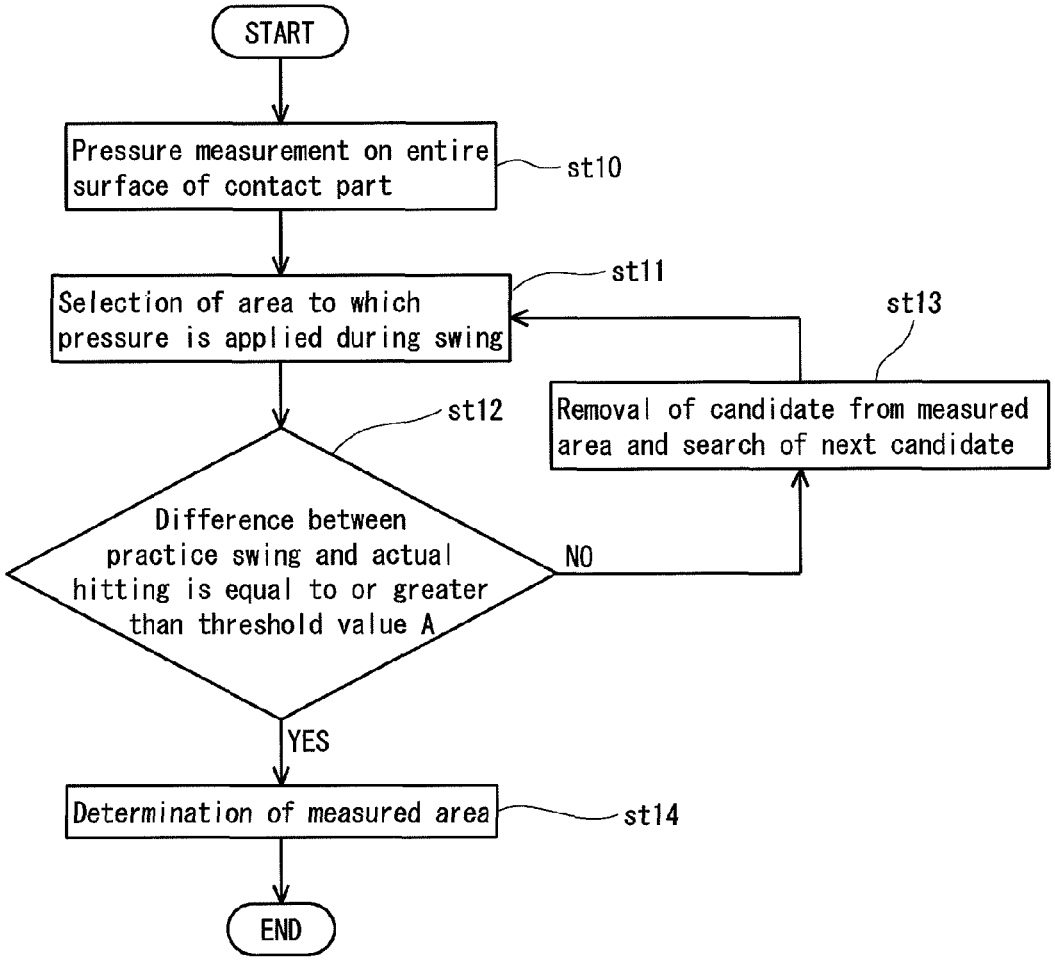
FIG. 4 is a flow chart showing an example of a method for selecting a measured area.

FIG. 4 is a flow chart showing an example of a procedure for determining the placement of the sensor. In a preferable embodiment of the present invention, a measured area is selected prior to the mounting of the sensor (the step st100).

In a preferable method for selecting a measured area, a pressure on the entire surface of a contact part is first measured (step st10). In step st10, pressure sensors are disposed on all contact surfaces between the swing subject h1 and the sport hitting tool c1. Next, an area to which a pressure is applied during the swing is selected (step st11). In the step st11, a pressure in the practice swing is compared to a pressure in the actual hitting. Next, it is decided whether a pressure difference between the practice swing and the actual hitting in a certain measured area is equal to or greater than a threshold value A (step st12). The threshold value A is suitably set to correspond to the swing subject h1 or the sport hitting tool c1 or the like. The threshold value A is preferably set so that correlation between the measured result finally obtained and the hit feeling is high.

When the pressure difference between the practice swing and the actual hitting is less than the threshold value A, the measured area is removed as a candidate, and another candidate is searched (step st13). It is determined whether the pressure difference of the other candidate is equal to or greater than the threshold value A (step st12). When the pressure difference is equal to or greater than the threshold value A, the area is determined as the measured area (step st14).

Figure 5:
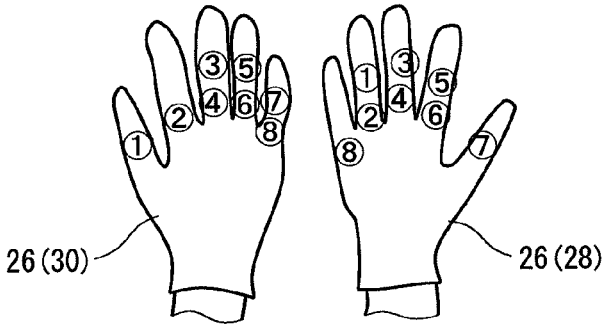
FIG. 5 is a diagram showing an example of the selected measured area.

FIG. 5 shows an example of the determined measured area. FIG. 5 shows a human being's hands with a glove 26. FIG. 5 is an illustration of a palm side. In the example, eight places of a right hand 28 and eight places of a left hand 30 are selected as the measured areas and sensors are mounted to the measured areas.

The specific example of the method for selecting the measured area will be described later.

The influence of the pressure obtained in the case of the practice swing is limited by selecting the measured area, and the pressure produced in actual hitting of the ball tends to govern the measured result. Therefore, the correlation between the measured result and the hit feeling tends to be obtained. On the other hand, when the measured area is excessively selected, the data is apt to depend on a local pressure. The excessive selection may reduce the correlation between the measured result and the hit feeling. In consideration of the correlation between the measured result and the hit feeling, or the like, the measured area is selected in a suitable range. In examples which will be described later, the integrated value Sf (increasing amount Psum or the like) is calculated based on the summation of the measured pressures. This is because the pressure is wholly grasped to enhance the correlation between the measured result and the hit feeling.

Figure 6:
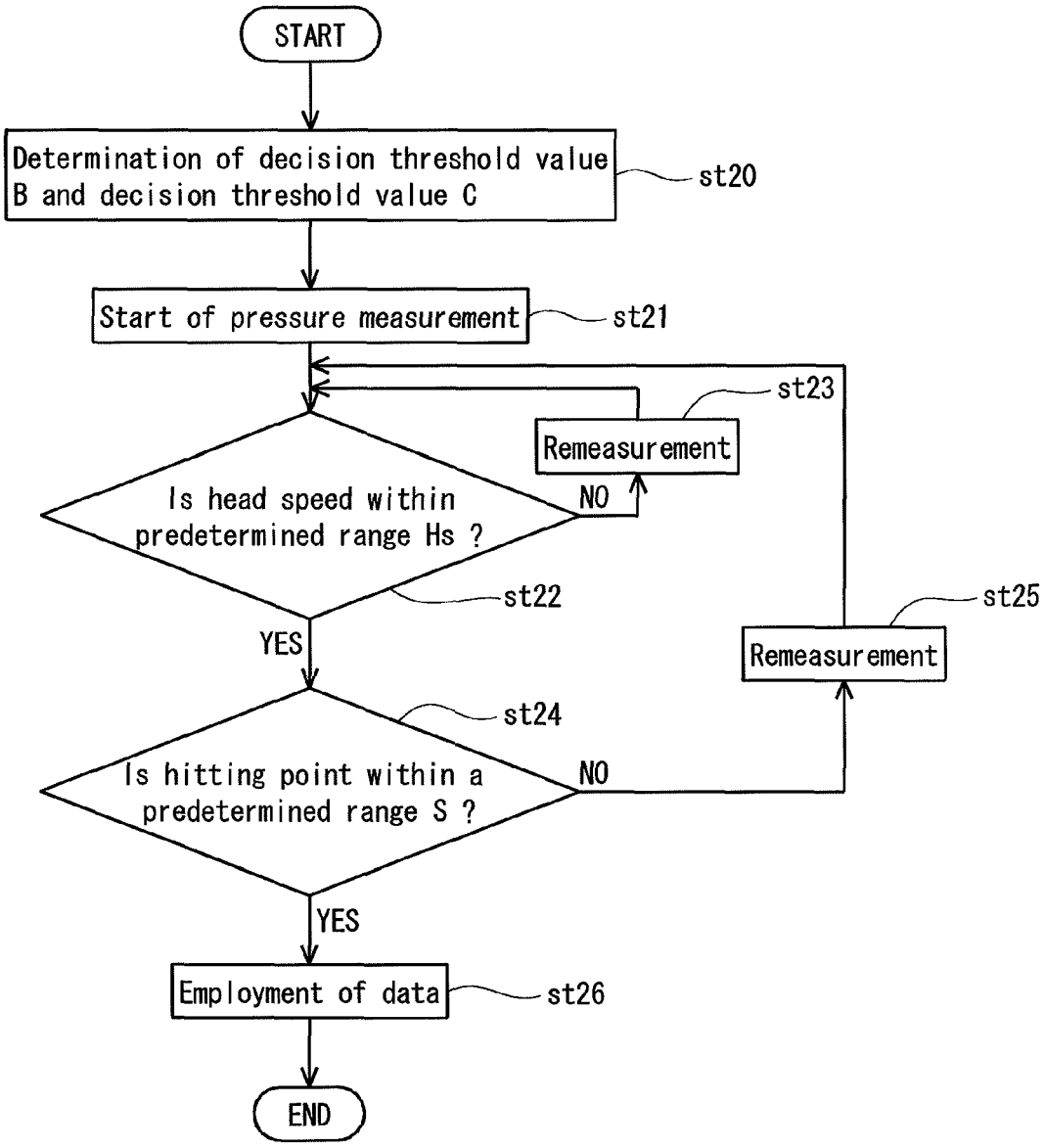
FIG. 6 is a flow chart showing an example of a method for equalizing a pending condition.

In data measurement according to the present invention, the data is preferably selected in consideration of a hitting ball condition. FIG. 6 is a flow chart showing an example of a procedure for selecting the data.

In the data selecting method, a decision threshold value B and a decision threshold value C are first determined (step st20). The threshold value B is a range of variation in a head speed, and, for example, is a range Hs which will be described later. The threshold value C is a range of variation in a hitting point, and, for example, is a predetermined range S which will be described later. So the threshold value B and the threshold value C are smaller, the variation in the hitting ball condition is reduced, and thereby the reliability of the data can be enhanced. On the other hand, when the threshold value B and the threshold value C are excessively small, particularly in the case where the swing subject h1 is the human being, it may become difficult to acquire the data which will be employed. When the threshold value B and the threshold value C are determined, for example, these situations are considered.

Next, a pressure is measured (step st21). The pressure measurement is by the actual hitting. Preferably, the pressure measurement is an example of the step st200 described above. Next, it is decided whether the head speed is within the predetermined range Hs (step st22). When the head speed is outside the predetermined range Hs, the pressure is measured once again (step st23). When the head speed is within the predetermined range Hs, it is further decided whether the hitting point is within the predetermined range S (step st24). When the hitting point is outside the predetermined range S, the pressure is measured once again (step st25). When the hitting point is within the predetermined range S, the data is employed (step st26).

The predetermined range S is not particularly limited. For example, the predetermined range S may be "a range in which a distance from a face center is equal to or less than X mm", "a range in which a distance from a sweet spot is equal to or less than X mm", or "a range having a radius of X mm" or the like. When the swing subject h1 is the human being, the variation in the hitting point is inevitably generated. Therefore, when the swing subject h1 is the human being, the required number of data may be hard to obtain by the excessive limitation of the predetermined range S. In this respect, for example, the distance X can be set to be equal to or greater than 2 mm, further equal to or greater than 5 mm, and further equal to or greater than about 7 mm. The upper limit of the distance X is not also limited. However, in respect of reliability of the measurement, for example, the distance X can be set to be equal to or less than 10 mm. Since the variation in the hitting point is less when the swing subject h1 is the swing robot, the distance X can be reduced. In this case, the distance X can be set to be equal to or less than 5 mm, and further equal to or less than 3 mm.

The head speed is an example of a swing speed. In respect of equalizing a measurement condition to obtain highly reliable data, the swing speed is preferably limited to the predetermined range Hs.

The hitting point and the swing speed can correlate with the grip pressure. In the structure of the golf club, a ball hitting surface does not exist on an extension line of a shaft axis line. Consequently, when the ball is hit, a rotation moment around the shaft axis line is generated to rotate the golf club around the shaft axis line. The swing subject may increase the grip pressure (unconsciously) in order to prevent slip of the grip caused by the rotation moment. Therefore, the swing speed and the hitting point may influence the grip pressure. Since a distance between the shaft axis line and the hitting point is greater as the hitting point is closer to a toe side, the rotation moment around the shaft axis line applied to the club from the ball is increased. When the swing speed is greater, the rotation moment around the shaft axis line applied to the club from the ball is increased. Therefore, the uniformity of the swing speed and the uniformity of the hitting point may fluctuate the grip pressure. In respect to eliminating a fluctuation in the grip pressure relevant to elements other than the hit feeling as much as possible, the measured data is preferably analyzed in consideration of the uniformity of the swing speed and/or the uniformity of the hitting point.

Figure 7:
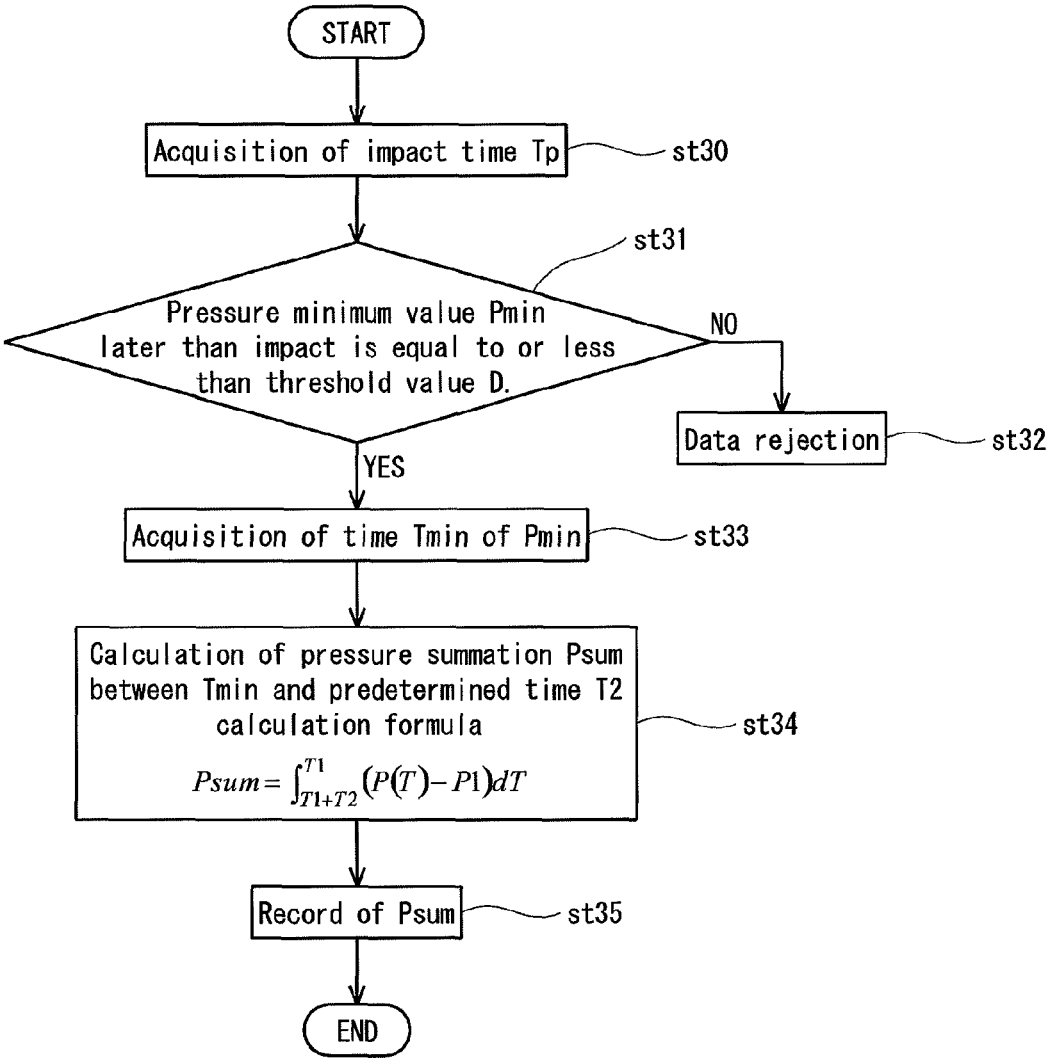
FIG. 7 is a flow chart showing an example of a data analysis method.

FIG. 7 is a flow chart showing a preferable example of the data analysis (step st300). In the data analysis, an impact time Tp is first acquired (step st30). The method for acquiring the impact time Tp is not limited. As will be described later, the impact time Tp can be obtained by the measured time-series pressure data. Since the impact time Tp is a time when the ball collides, the impact time Tp can be recognized by an image and a sound or the like. The impact time Tp is acquired by various methods including these methods.

Next, it is decided whether the minimum value Pmin of a pressure at a time later than the impact time Tp is equal to or less than a threshold value D (step st31). As shown by data which will be described later, it was found that the pressure tends to be temporarily reduced immediately after the impact time Tp. Therefore, the inventors considered the use of the temporary reduction of the pressure as an indicator for deciding whether the data is normal. When the minimum value Pmin of the pressure at the time later than the impact time Tp exceeds the predetermined threshold value D, the data is rejected (step st32).

When the minimum value Pmin of the pressure at the time later than the impact time Tp is equal to or less than the predetermined threshold value D, the data is employed. Next, a time Tmin when the pressure is the minimum value Pmin is acquired (step st33).

When a time when the pressure reaches the maximum until 50 msec elapses after the impact time Tp is Tmax, the time Tmin is preferably a time when the pressure reaches the minimum between the impact time Tp and the time Tmax. Thus, it was found that the correlation between the increasing amount Psum which will be described later and the hit feeling is comparatively high when the time Tmin is set in this manner. Evaluation based on the increasing amount Psum is an example of evaluation based on the integrated value Sf.

Next, in the time-series data of the measured pressure, the increasing amount Psum between the time Tmin and T2 is calculated (step st34). The summation Psum is calculated based on an integration value of a function with time and pressure as variables, with respect to time. The integration value is an integration value in a specified period Z12 between a time T1 after impact and a time T2. The time Tmin is a preferable example of the time T1. An analysis based on the increasing amount Psum is a preferable example of that based on the integrated value Sf.

The time T2 is not limited, as long as the time T2 is later than the time T1. A preferable example of the time T2 is the time Tmax when the pressure reaches the maximum at a time later than the impact time Tp.

A time difference (specified period Z12) between the time T1 and the time T2 is not limited. However, with respect to the correlation between the time difference and the hit feeling, the time difference is preferably equal to or greater than 5 msec and more, preferably equal to or greater than 10 msec. On the other hand, the grip pressure during follow-through is apt to be varied. Accordingly, when the time difference is excessively long, the correlation between the time difference and the hit feeling is apt to be reduced. In this respect, the time difference (specified period Z12) between the time T1 and the time T2 is preferably equal to or less than 100 msec, more preferably equal to or less than 50 msec, and still more preferably equal to or less than 25 msec.

Preferably, the obtained summation (increasing amount) Psum is recorded (step st35). As shown by data which will be described later, it was found that the summation Psum can correlate with the hit feeling.

As described in the above embodiment, the present invention is the method for quantitatively evaluating the hit feeling of the sport hitting tool. The method includes: a first step of using the measuring means M1 capable of measuring the forces F acting between the swing subject and the sport hitting tool or the specific directional components F1 thereof to obtain values of the forces F or the components F1 at times after impact; and a second step of deciding the hit feeling based on the value of the force F or the component F1. It was found that the value of the force F or the component F1 at at least one of the times can correlate with the hit feeling. The time after impact includes the impact time.

Preferably, the values of the forces F or the components F1 in the specified period Z12 between the time T1 and the time T2 after the impact are obtained in time series in the first step, and the hit feeling is decided based on the integrated value Sf of the forces F or the components F1 in the specified period Z12 in the second step. It was found that the integrated value Sf has excellent correlation with the hit feeling.

It was found that examples of an index having excellent correlation with the hit feeling other than the integrated value Sf include the rate Rd of change. The rate Rd of change is a rate of change of the forces F or the components F1 in the specified period Z12.

Preferably, the time T1 is defined as the time Tmin when the force F or the component F1 reaches the minimum. In this case, the correlation between the rate of change and the hit feeling can be enhanced. It was found that the phenomenon that the force F or the component F1 is reduced immediately after the impact is generated. It was also found that the setting of the time Tmin as the time T1 contributes to enhancement in the correlation between the rate of change and the hit feeling.

With respect to the correlation between the rate of change and the hit feeling, it was found that the time Tmin is preferably between the impact time Tp and the time Tmax.

The measuring means M1 includes the pressure sensor provided on the palm of the swing subject, and a setting position of the pressure sensor is determined based on comparison of a distribution Dp of the forces F or the components F1 in the practice swing with a distribution Ds of the forces F or the components F1 in the actual hitting. The inventors consider that relevance between the data observed in the practice swing and the hit feeling to be low. Therefore, a portion having high relevance with the hit feeling can be selected by the comparison of the distribution Dp with the distribution Ds. The data having high correlation with the hit feeling can be obtained by setting the sensor at a position where a difference between the practice swing and the actual hitting is great.

As described above, the moment around the shaft axis line is generated when the ball is hit. The moment causes the rotation of the golf club around the shaft axis line. The rotation may cause the generation of a slip between the human hand (swing subject) and the grip of the golf club (sport hitting tool). The human body may sense the amplitude of the slip to unconsciously adjust a grasping force. So the human body senses a greater slip, the human body may increase the grasping force. The unconscious adjustment of the grasping force is presumed to bring about the correlation between the hit feeling and the pressure.

In the measurement according to the present invention, for example, a triaxial force sensor and a six-axis force sensor or the like may be used in addition to the pressure sensor.

EXAMPLES

Hereinafter, the effects of the present invention will be clarified by examples. However, the present invention should not be interpreted in a limited way based on the description of the examples.

[Test 1] Selection of Measured Area (Step st10 to Step st14)

A pressure sensor was attached to the entire surface of a grip part of a golf club. "Pinch-A 3-40" (trade name) manufactured by Nitta Corporation was used as the sensor. A sensor part of the sensor does not cover the entire surface of a grip, but has an area covering a semiperimeter surface of the grip. Consequently, measurement in which the sensor part was provided on the upper semiperimeter surface of the grip, and measurement in which the sensor part was provided on the lower semiperimeter surface of the grip were carried out. A pressure on the whole surface of a contact part is measured by the two measurements.

Figure 8:
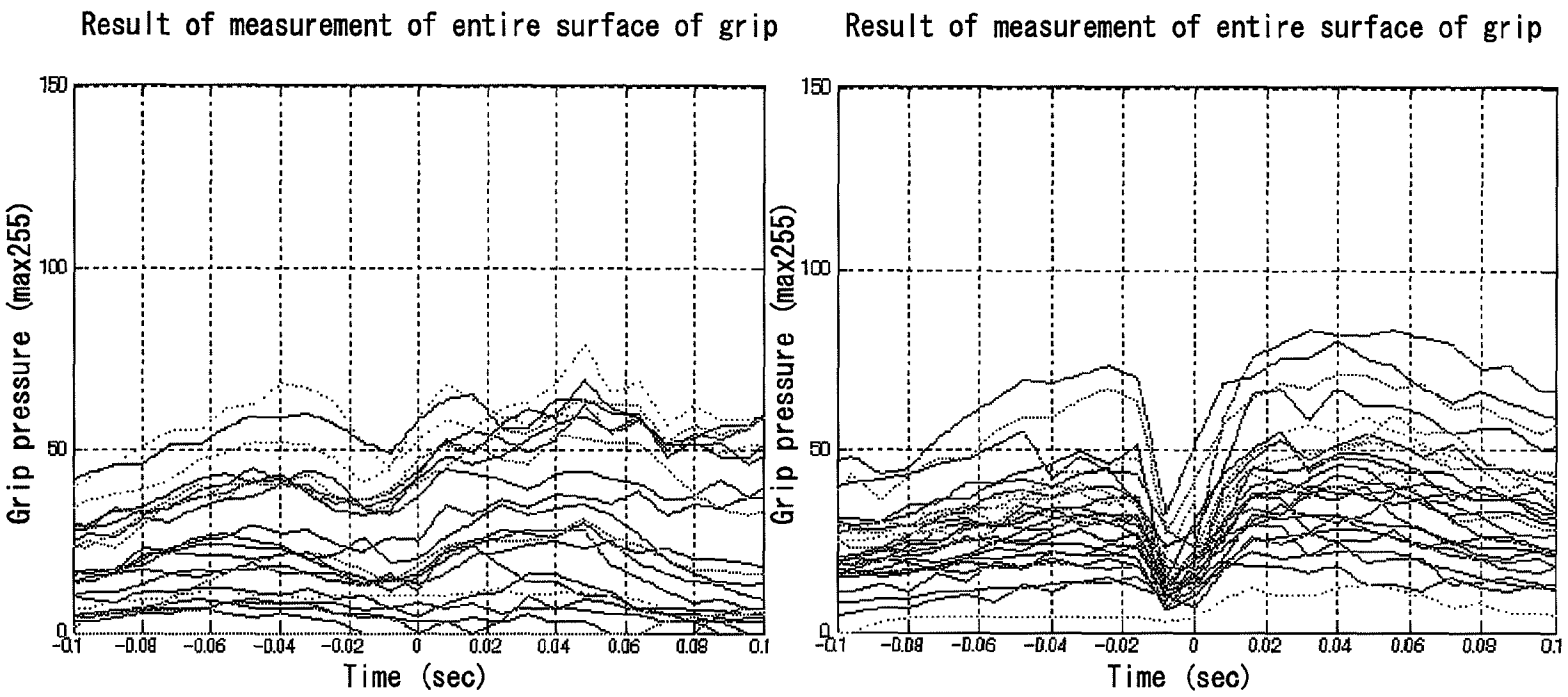
FIG. 8 shows measured results for selecting the measured area, and is data near a second joint of a right middle finger.
Figure 9:
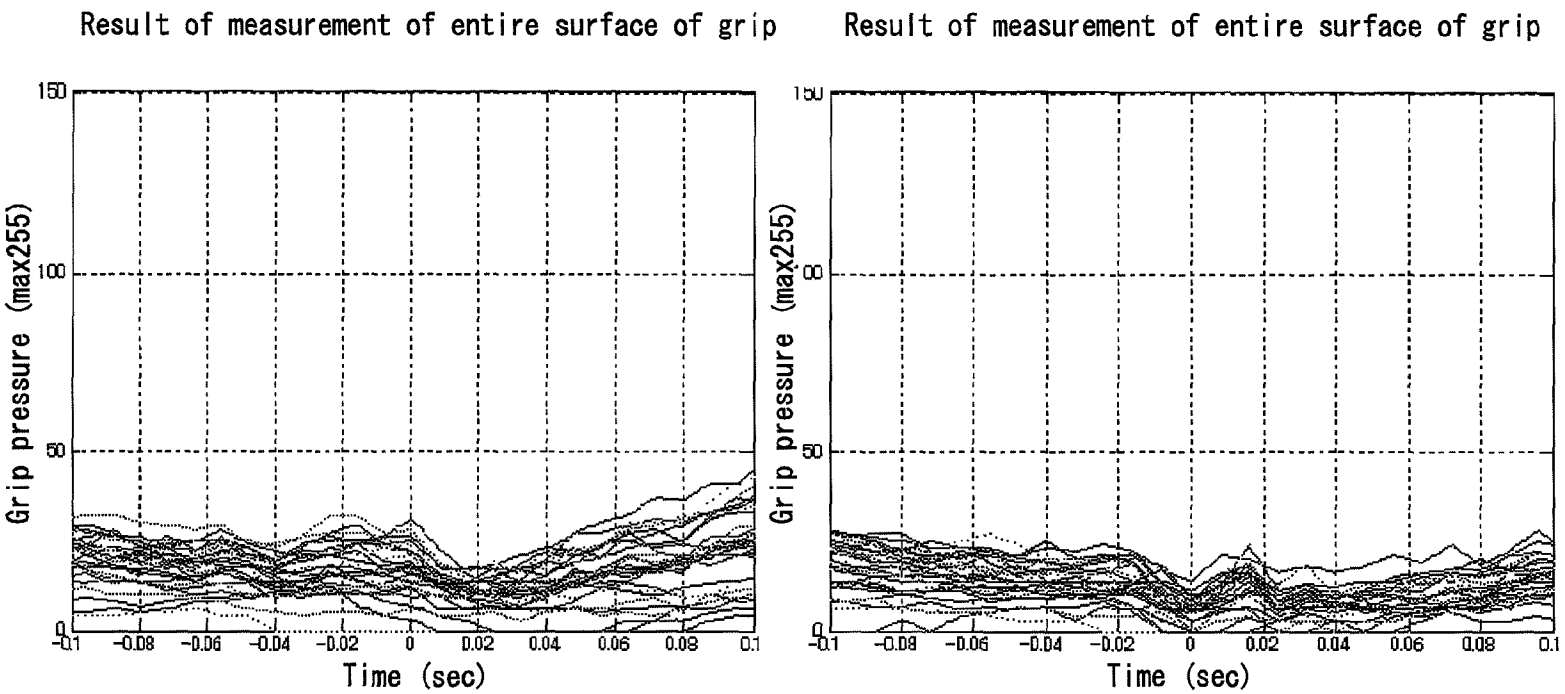
FIG. 9 shows measured results for selecting the measured area, and is data near a first joint of a left little finger.

FIGS. 8 and 9 show a part of the measured results on the whole surface of the contact part. In these figures, a left side graph shows measured results in a practice swing, and a right side graph shows measured results in actual hitting. When a difference between the left side graph and the right side graph is large, the area is selected. In FIGS. 8 and 9, each of graph lines shows each of measured values of a large number of pressure measuring elements provided on the sensor. A horizontal axis line of the graph is time, and a vertical axis line of the graph is pressure.

FIG. 8 shows a part of measured results of a tester K. FIG. 8 shows data near the second joint of a right middle finger.

As shown in the graph of FIG. 8, a difference between the practice swing and the actual hitting in the data of the tester K is observed. The difference between the practice swing and the actual hitting in the other area was decided. A graph was obtained for each area other than the graph of FIG. 8. Based on these graphs, an area in which the difference between the practice swing and the actual hitting was particularly great was decided. The area in which the difference between the practice swing and the actual hitting is great can be selected by the measurement. In the selection, the threshold value A described above is not particularly limited. For example, the threshold value A can be suitably determined so that correlation between the increasing amount Psum or the rate Rd of change and hit feeling is high.

FIG. 9 shows a part of the measured results of a tester S. FIG. 9 shows data near a first joint of a left little finger.

As shown in the graph of FIG. 9, a difference between the practice swing and the actual hitting in the data of the tester S is also observed. The difference between the practice swing and the actual hitting was decided in other areas. A graph was obtained for each area other than the graph of FIG. 9. Based on these graphs, an area in which the difference between the practice swing and the actual hitting was particularly great was decided. The area in which the difference between the practice swing and the actual hitting is great can be selected by the measurement. In the selection, the threshold value A is not particularly limited. For example, the threshold value A can be suitably determined so that correlation between the increasing amount Psum or the rate Rd of change and hit feeling is high.

[Test 2] Pressure Measurement 1 in Actual Hitting

In test 2, pressure measurement (the step st200) and data analysis (the step st300) in actual hitting were carried out. "Octosense" (trade name) (part number 08107B005) manufactured by Nitta Corporation was used as a pressure measuring system including a sheet-like pressure sensor. The "Octosense" is a wired pressure measuring system. One "Octosense" has eight sensor parts. Two "Octosenses" were used. A first "Octosense" was used for a right hand, and eight sensor parts were disposed on the right hand. A second "Octosense" was used for a left hand, and eight sensor parts was disposed on the left hand. The sensor parts are disposed on the sixteen places shown in FIG. 5. These sensor parts were attached on a golf glove. The sixteen places are areas in which the difference between the practice swing and the actual hitting is comparatively great in the measurement of the test 1. The measured pressure is the force Fz.

Two high speed cameras synchronized with each other were used in order to detect an impact time, and to determine the time axis of the measured data of the "Octosense". Since the "Octosense" did not have a synchronous function, one of the two high speed cameras photographed an LED lamp emitting light simultaneously with the measurement start of the "Octosense". The other camera photographed the moment of collision (impact) of a ball with a head.

A tester was a golf player A. A sampling frequency for pressure measurement was set to 200 Hz. A wedge was used as the golf club. Head speed was measured simultaneously with the pressure measurement, and data was only used when the head speed was 16.0 m/s or greater and 18.0 m/s or less. That is, the predetermined range Hs was set to 16.0 m/s or greater and 18.0 m/s or less. The head speed range corresponds to the head speed of the wedge in an approach shot. The hit feeling is known to be sensed in the approach shot.

Simultaneously with the pressure measurement, a high speed camera photographed the swing. An impact time Tp was detected based on an image obtained by photographing the swing.

Four hits by the golf player A were measured.

Figure 10:
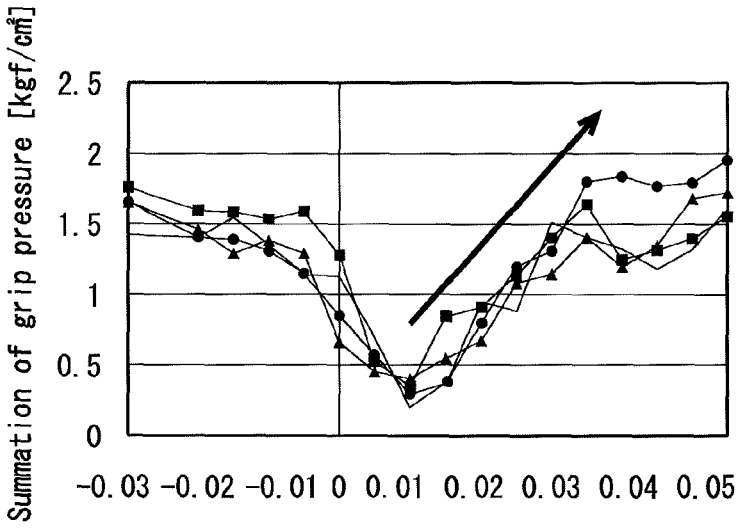
FIG. 10 is a graph showing an example of time-series measured data of a grip pressure.
Figure 11:
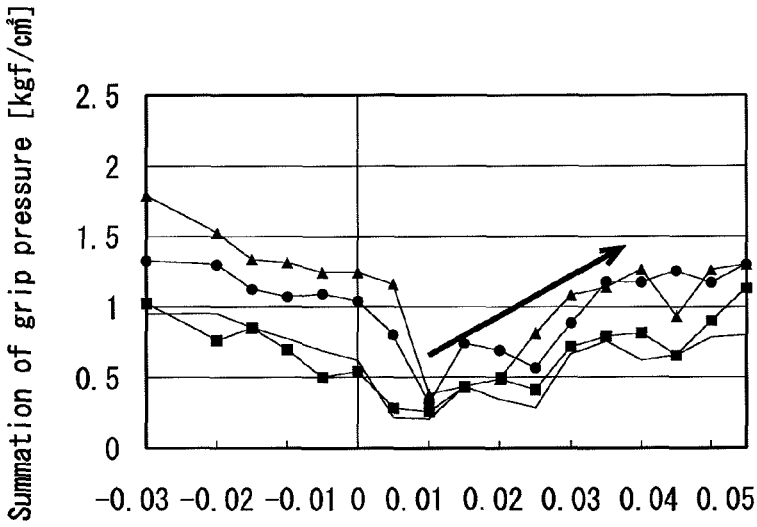
FIG. 11 is a graph showing another example of the time-series measured data of the grip pressure.

FIG. 10 shows measured results of a ball functionally evaluated as a hard hitting feeling. A horizontal axis line is time and a vertical axis line is pressure (summation of pressures of sixteen places). Four data are shown by four graphs. FIG. 11 shows measured results of a ball functionally evaluated as a soft hitting feeling. A horizontal axis line is time and a vertical axis line is pressure (summation of pressures of sixteen places). Four data are shown by four graphs. The time of the horizontal axis line is seconds.

In FIGS. 10 and 11, time zero is the impact time Tp.

As shown in FIGS. 10 and 11, the reduction of the grip pressure is observed immediately after the impact time Tp (about 0.01 second after the impact time Tp). The rate of change from the pressure reducing time of FIG. 10 is greater than that of FIG. 11. That is, the rate Rd of change of FIG. 10 is greater than the rate of change Rd of FIG. 11. Thus, the hit feeling and the rate Rd of change correlate with each other. The present inventors consider that the harder the hit feeling, the greater the rate Rd of change, and the softer the hit feeling, the smaller the rate Rd of change.

[Test 3] Pressure Measurement 2 in Actual Hitting

Measurement was carried out using the same pressure sensor as that of test 2. A tester was a golf player B. A sampling frequency for pressure measurement was set to 1000 Hz. A wedge was used as the golf club. Data was sued when a head speed was 16.0 m/s or greater and 18.0 m/s or less. As the sampling frequency is higher, the number of measured data per unit time is increased, and thereby data precision can be enhanced. In this respect, the sampling frequency in the pressure measurement is preferably equal to or greater than 100 Hz, more preferably equal to or greater than 200 Hz, and still more preferably equal to or greater than 1000 Hz.

Simultaneously with the pressure measurement, a high speed camera photographed the to detect an impact time Tp which was defined as time zero.

Figure 12:
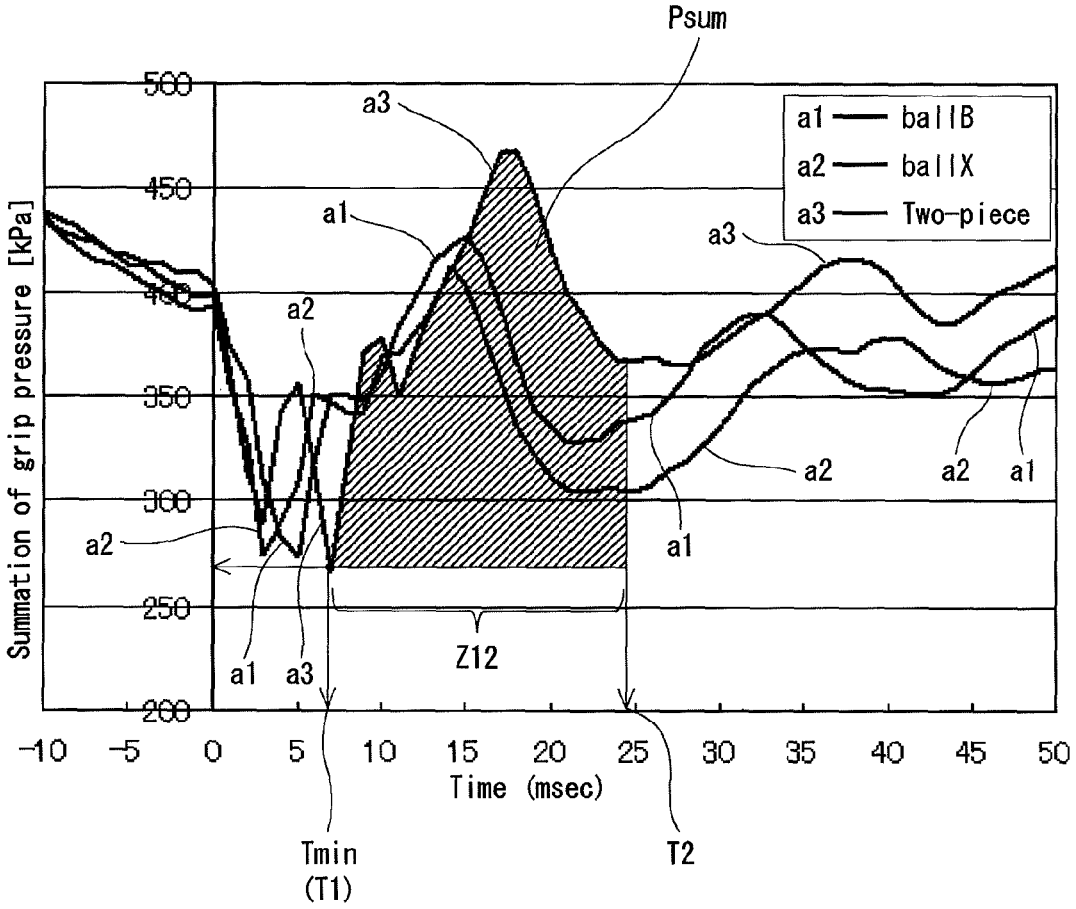
FIG. 12 is a graph showing another example of the time-series measured data of the grip pressure.

FIG. 12 is a graph in which test results of three kinds of balls are overlapped and shown. A horizontal axis line is time and a vertical axis line is pressure. The pressure is the summation of data of all sensor parts.

A measured result of a ball B which is commercially available is shown by numeral character a1 in FIG. 12. A measured result of a ball X manufactured by SRI Sports Limited is shown by numeral character a2 in FIG. 12. A measured result of a two-piece ball which is commercially available is shown by numeral character a3 in FIG. 12. In these three kinds of balls, the two-piece ball is functionally evaluated as having a "hard" hitting feeling. On the other hand, the ball B and the ball X are functionally evaluated as having a "soft" hitting feeling. The specifications and the evaluation results of the ball B and the ball X are shown in Table 1 which will be described later.

An increasing amount Psum in a specified period Z12 (between a time T1 and a time T2) for the data of the two-piece ball is shown as a hatched area in FIG. 12. The time Tmin is employed as the time T1. It was found that the increasing amount Psum correlates with the hitting ball feeling. A correlation was found between the greater the increasing amount Psum and the harder the hitting feeling.

Figure 13:
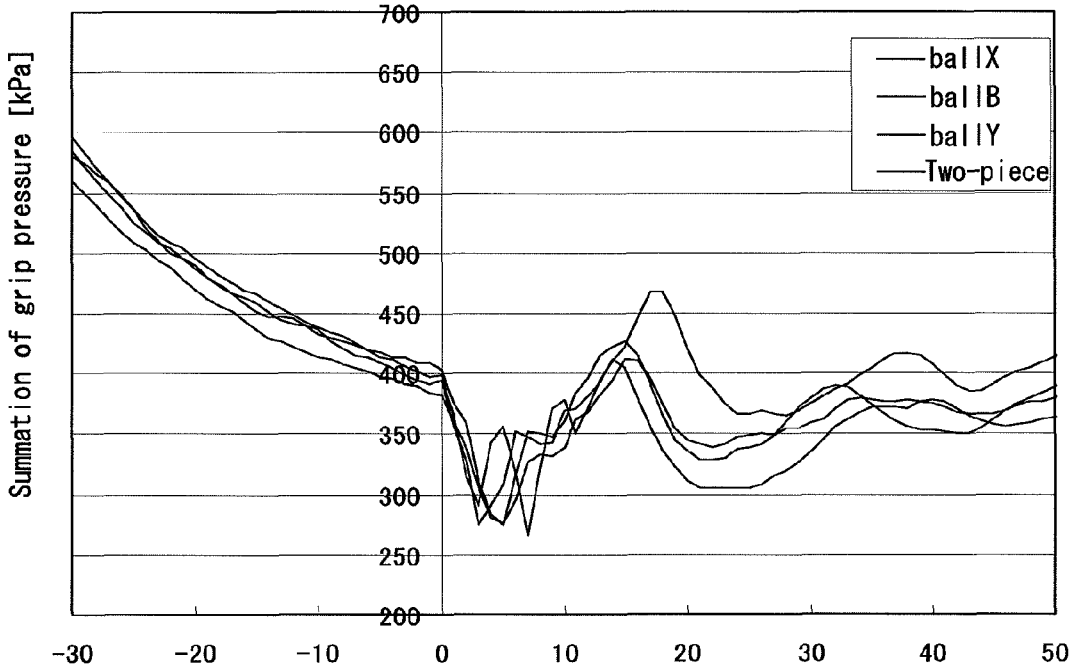
FIG. 13 is a graph showing another example of the time-series measured data of the grip pressure.
Figure 14:
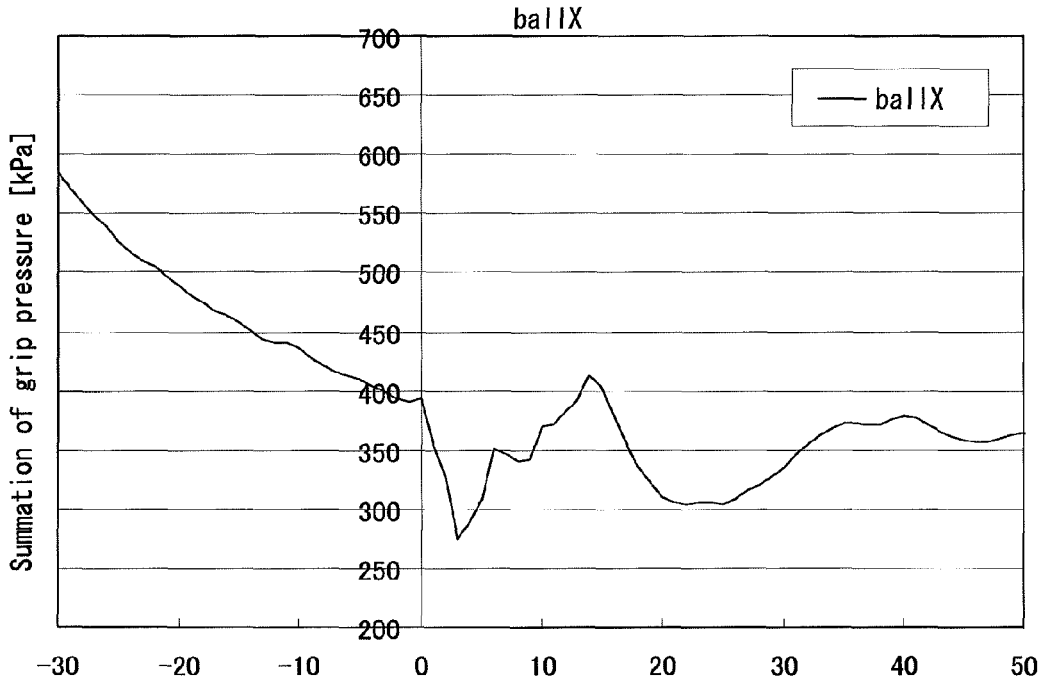
FIG. 14 is a graph showing one of four graph lines shown in FIG. 13.
Figure 15:
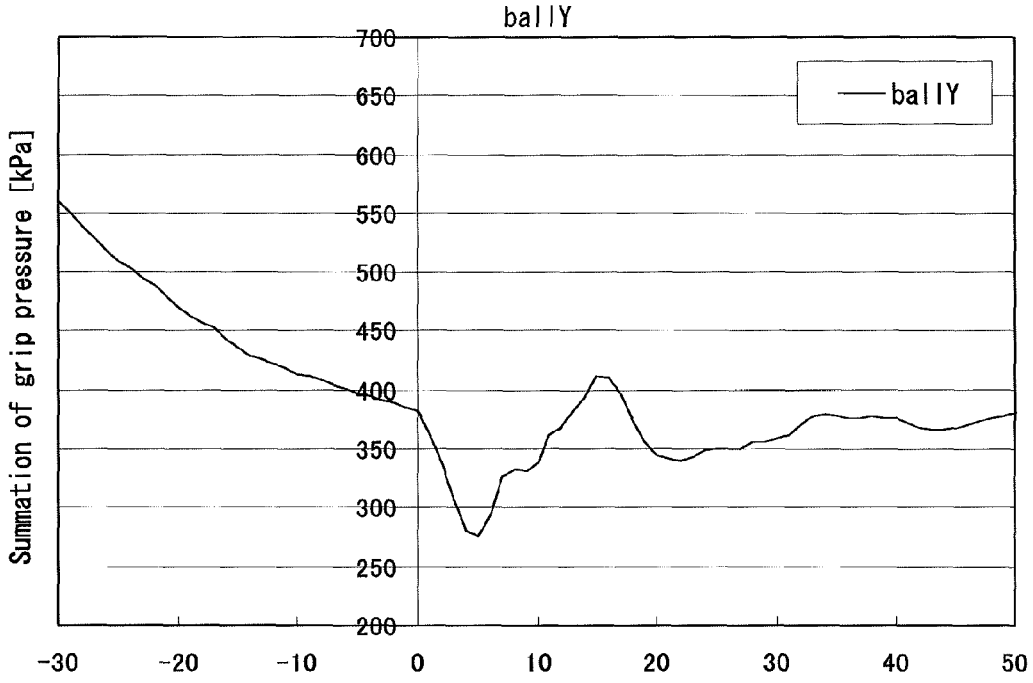
FIG. 15 is a graph showing another one of four graph lines shown in FIG. 13.
Figure 16:
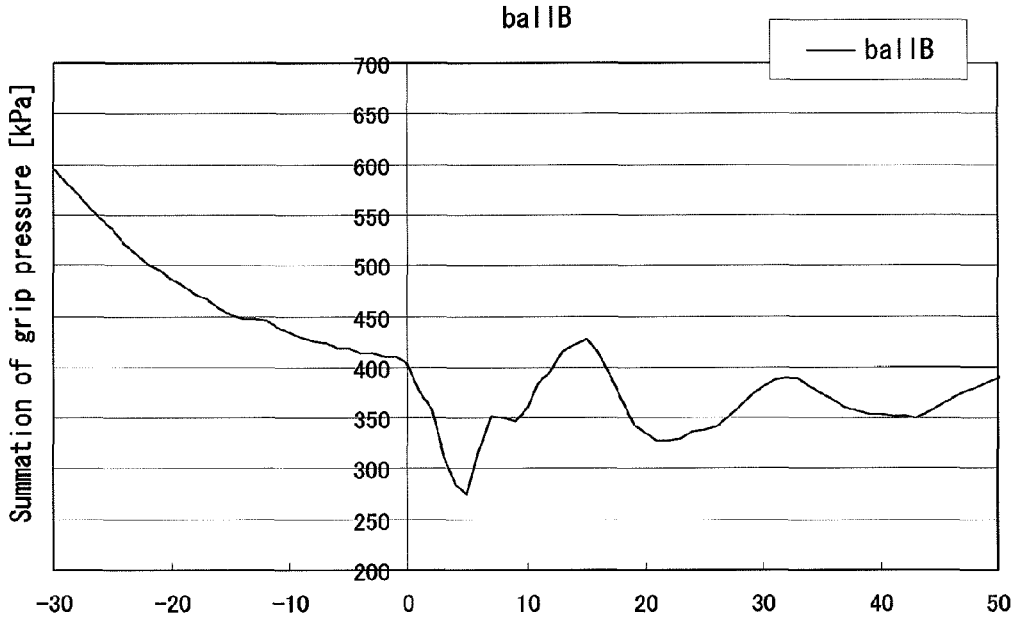
FIG. 16 is a graph showing still another one of four graph lines shown in FIG. 13.
Figure 17:
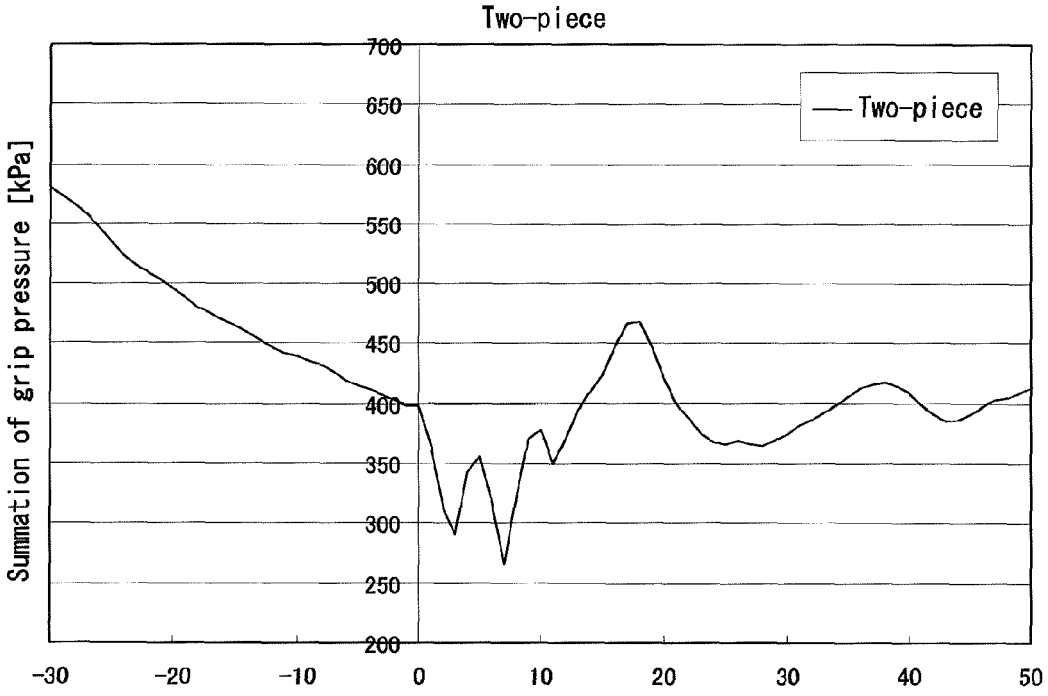
FIG. 17 is a graph showing still another one of four graph lines shown in FIG. 13.

FIG. 13 is a graph based on the same data as FIG. 12. In FIG. 13, a test result of a fourth kind of ball is added to the results of the three kinds of balls shown in FIG. 12. FIGS. 14 to 17 are graphs showing the results of the four balls. The unit of the time of the horizontal axis line is msec. The pressure is the summation of data of all sensor parts.

The balls are the ball B, the ball X, the two-piece ball and, a ball Y manufactured by SRI Sports Limited. As shown in the graph of FIG. 13, the integrated value Sf (Psum) and the rate Rd of change of the two-piece ball evaluated as hard hitting feeling tended to be greater than those of the other three kinds of golf balls.

[Test 4] Pressure Measurement 4 in Actual Hitting

An advanced level golf player G1 having a handicap of less than 5 carried out measurement in the same manner as in the test 3. A commercially available ball A, the ball B, the ball X, the two-piece ball, and the ball Y were used. A sampling frequency for pressure measurement was set to 200 Hz. Functional evaluation results by the golf player G1 to these balls are as follows.

Figure 18:
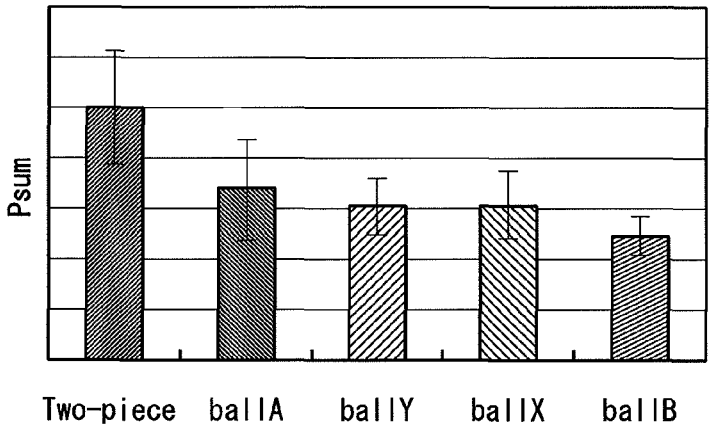
FIG. 18 is a bar graph showing an example of a measured result of an increasing amount Psum in each of several different balls.

Two-piece ball: very hard
Ball A: soft
Ball Y: soft
Ball X: soft
Ball B: very soft In each of the balls, a value of an increasing amount Psum between a time Tmin (0.01 second after an impact time Tp) and T2 (0.035 second after the impact time Tp) was calculated. The value is shown by a bar graph of FIG. 18. As shown in the result, hit feeling and the value of the increasing amount Psum correlate with each other. Error bars are appended in bar graphs described in the present application, including FIG. 18. The error bars show standard deviation.

[Test 5] Pressure Measurement 5 in Actual Hitting

An advanced level golf player G2 having a handicap of less than 5 carried out measurement in the same manner as in the test 4. A commercially available ball A, the ball B, the ball X, and the ball Y were used as the balls. A sampling frequency for pressure measurement was set to 200 Hz. Functional evaluation results by the golf player G2 to these balls are as follows.

Ball A: soft
Ball Y: soft
Ball B: very soft
Ball X: very soft

Figure 19:
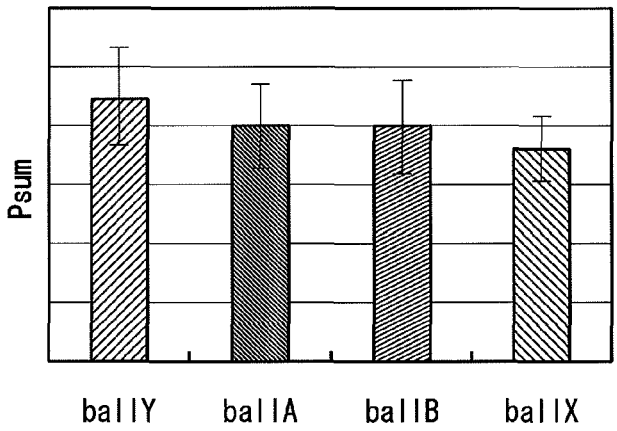
FIG. 19 is a bar graph showing an example of a measured result of an increasing amount Psum in each of several different balls.

In each of the balls, a value of an increasing amount Psum between a time Tmin (0.01 second after an impact time Tp) and T2 (0.035 second after the impact time Tp) was calculated. The value is shown by a bar graph of FIG. 19. As shown in the result, hit feeling and the value of the increasing amount Psum correlate with each other.

[Test 6] Verification by Professional Golf Player or Advanced Level Golf Player

Figure 20:
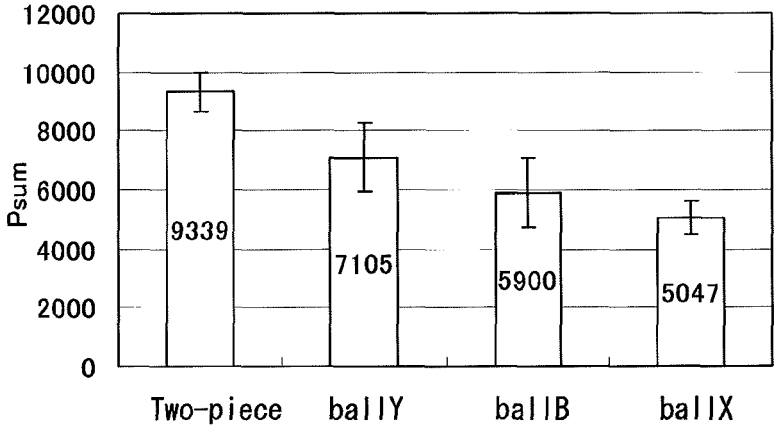
FIG. 20 is a bar graph showing an example of a measured result of an increasing amount Psum in each of several different balls.

A professional golf player P1 carried out measurement in the same manner as in the test 4. A sampling frequency for pressure measurement was set to 1000 Hz. The two-piece ball, the ball Y, the ball B, and the ball X were used as the balls. As the functional evaluation results by the golf player P1 to these balls, the balls were the ball X as the first, the ball B as the second, the ball Y as the third, and the two-piece ball as the fourth in an order from the softest ball. FIG. 20 shows measured results (average value) of an increasing amount Psum by the professional golf player P1.

Table 1 shows results (P value) of significant difference test in the test 6. The result means that the smaller the P value, the higher the existing probability of the significant difference. When the P value is particularly less than 5%, it can be decided that there is a significant difference. As shown in Table 1, the P value between the ball Y and the two-piece ball is 0.5%, and the significant difference is recognized. Similarly, the significant difference is recognized between the ball B and the two-piece ball, between the ball X and the two-piece ball and between the ball X and the ball Y. These results highly correlate with the functional evaluation by the professional golf player P1.

TABLE 1

Results of significant difference test (P value)

| | Two-piece ball | ball Y | ball B | ball X |
|---|---|---|---|---|
| Two-piece ball | | 0.5% | 0.0% | 0.0% |
| ball Y | | | 7.0% | 0.7% |
| ball B | | | | 9.2% |
| ball X | | | | |

[Test 7] Verification by Professional Golf Player or Advanced Level Golf Player

Figure 21:
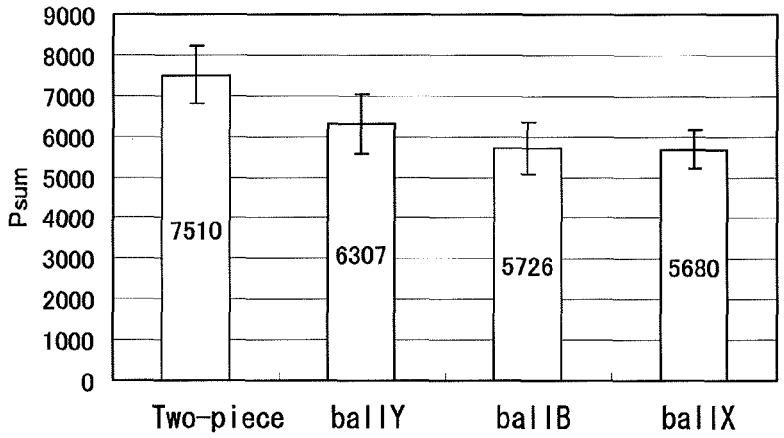
FIG. 21 is a bar graph showing an example of a measured result of an increasing amount Psum in each of several different balls.

A professional golf player P2 carried out measurement in the same manner as in the test 6. As the functional evaluation results by the golf player P2, the balls were the ball X and the ball B as the first, the ball Y as the third, and the two-piece ball as the fourth in order from the softest ball. A sampling frequency for pressure measurement was set to 1000 Hz. FIG. 21 shows measured results (average value) of an increasing amount Psum by the professional golf player P2.

Table 2 shows results (P value) of significant difference test in the test 7. As shown in Table 2, the P value between the ball Y and the two-piece ball is 0.6%, and the significant difference is recognized. Similarly, the significant difference is recognized between the ball B and the two-piece ball and between the ball X and the two-piece ball. On the other hand, the P value between the ball X and the ball B is 43.9%, and the significant difference is not recognized. These results highly correlate with the functional evaluation by the professional golf player P2.

TABLE 2

| Results of significant difference test (P value) | | | |
|---|---|---|---|
| Two-piece ball | ball Y | ball B | ball X |
| Two-piece ball | 0.6% | 0.0% | 0.0% |
| ball Y | | 7.5% | 5.4% |
| ball B | | | 43.9% |
| ball X | | | |

[Test 8] Verification by Professional Golf Player or Advanced Level Golf Player

Figure 22:
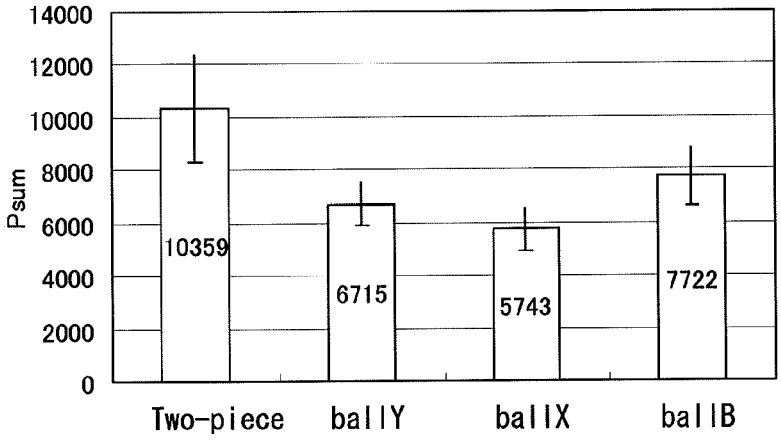
FIG. 22 is a bar graph showing an example of a measured result of an increasing amount Psum in each of several different balls.

An amateur golf player A1 carried out measurement in the same manner as in the test 6. As the functional evaluation results by the golf player A1, the balls were the ball X as the first, the ball Y as the second, the ball B as the third, and the two-piece ball as the fourth in order from the softest ball. A sampling frequency for pressure measurement was set to 1000 Hz. FIG. 22 shows measured results (average value) of an increasing amount Psum by the golf player A1.

Table 3 shows a result (P value) of significant difference test in the test 8. As shown in Table 3, the P value between the ball Y and the two-piece ball is 0.6%, and the significant difference is recognized. Similarly, the significant difference is also recognized between the ball X and the two-piece ball, between the ball B and the two-piece ball, between the ball B and the ball X, and between the ball X and the ball Y. These results highly correlate with the functional evaluation by the golf player A1.

TABLE 3

| Results of significant difference test (P value) | | | |
|---|---|---|---|
| Two-piece ball | ball Y | ball X | ball B |
| Two-piece ball | 0.6% | 0.3% | 2.1% |
| ball Y | | 3.5% | 5.7% |
| ball X | | | 0.3% |
| ball B | | | |

[Test 9] Verification by Professional Golf Player or Advanced Level Golf Player

Figure 23:
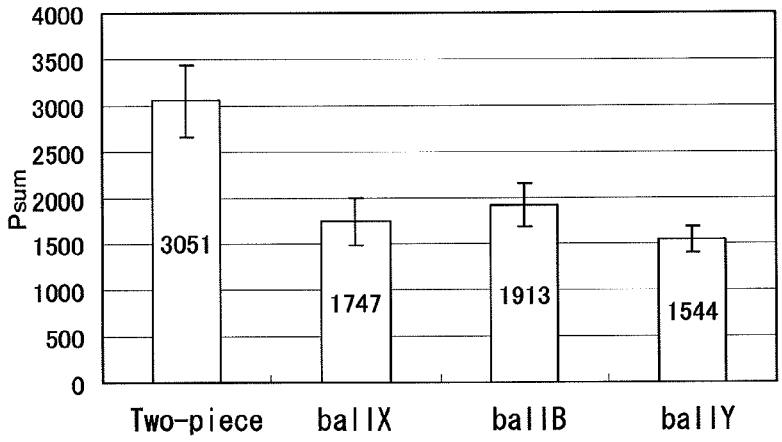
FIG. 23 is a bar graph showing an example of a measured result of an increasing amount Psum in each of several different balls.

An amateur golf player A2 carried out measurement in the same manner as in the test 6. As the functional evaluation results by the golf player A2, the balls were the ball Y as the first, the ball X as the second, the ball B as the third, and the two-piece ball as the fourth in an order from the softest ball. A sampling frequency for pressure measurement was set to 1000 Hz. FIG. 23 shows measured results (average value) of an increasing amount Psum by the golf player A2.

Table 4 shows results (P value) of significant difference test in the test 9. As shown in Table 4, the P value between the ball X and the two-piece ball is 0.0%, and the significant difference is recognized. Similarly, the significant difference is also recognized between the ball B and the two-piece ball, between the ball Y and the two-piece ball, between the ball B and the ball Y, and between the ball X and the ball Y. These results highly correlate with the functional evaluation by the golf player A2.

TABLE 4

| Results of significant difference test (P value) | | | |
|---|---|---|---|
| Two-piece ball | ball X | ball B | ball Y |
| Two-piece ball | 0.0% | 0.1% | 0.0% |
| ball X | | 8.2% | 2.8% |
| ball B | | | 0.1% |
| ball Y | | | |

Figure 24:
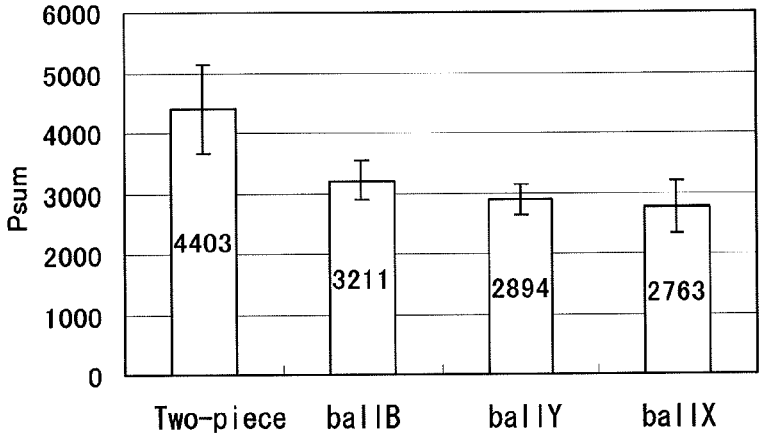
FIG. 24 is a bar graph showing an example of a measured result of an increasing amount Psum in each of several different balls.

[Test 10] Verification by Professional Golf Player or Advanced Level Golf Player An amateur golf player A3 carried out measurement in the same manner as in the test 6. As the functional evaluation results by the golf player A3, the balls were the ball Y and the ball X as the first, the ball B as the third, and the two-piece ball as the fourth in an order from the softest ball. A sampling frequency for pressure measurement was set to 1000 Hz. FIG. 24 shows measured results (average value) of an increasing amount Psum by the golf player A3.

Table 5 shows a result (P value) of significant difference test in the test 10. As shown in Table 5, the P value between the ball B and the two-piece ball is 0.1%, and the significant difference is recognized. Similarly, the significant difference is also recognized between the ball Y and the two-piece ball, between the ball X and the two-piece ball, between the ball B and the ball Y, and between the ball X and the ball B. On the other hand, the P value between the ball X and the ball Y is 25.1%, and the significant difference is not recognized. These results highly correlate with the functional evaluation by the golf player A3.

TABLE 5

| Results of significant difference test (P value) | | | |
|---|---|---|---|
| Two-piece ball | ball B | ball Y | ball X |
| Two-piece ball | 0.1% | 0.0% | 0.0% |
| ball B | | 3.1% | 2.6% |
| ball Y | | | 25.1% |
| ball X | | | |

Figure 25:
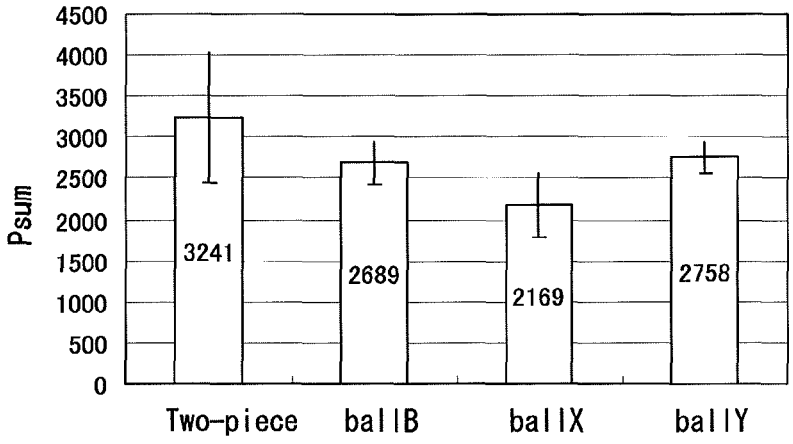
FIG. 25 is a bar graph showing an example of a measured result of an increasing amount Psum in each of several different balls.

[Test 11] Verification by Professional Golf Player or Advanced Level Golf Player An amateur golf player A4 carried out measurement in the same manner as in the test 6. As the functional evaluation results by the golf player A4, the balls were the ball X as the first, the ball Y and the ball B as the second, and the two-piece ball as the fourth in an order from the softest ball. A sampling frequency for pressure measurement was set to 1000 Hz. FIG. 25 shows measured results (average value) of an increasing amount Psum by the golf player A4.

Table 6 shows results (P value) of significant difference test in the test 11. As shown in Table 6, the significant difference is recognized between the ball X and the two-piece ball, between the ball Y and the ball X, and between the ball X and the ball B. On the other hand, the P value between the ball Y and the ball B is 32.2%, and the significant difference is not recognized. These results highly correlate with the functional evaluation by the golf player A4.

TABLE 6

| Results of significant difference test (P value) | | | |
|---|---|---|---|
| Two-piece ball | ball B | ball X | ball Y |
| Two-piece ball | 7.9% | 1.1% | 10.1% |
| ball B | | 3.4% | 32.2% |
| ball X | | | 2.3% |
| ball Y | | | |

Figure 26:
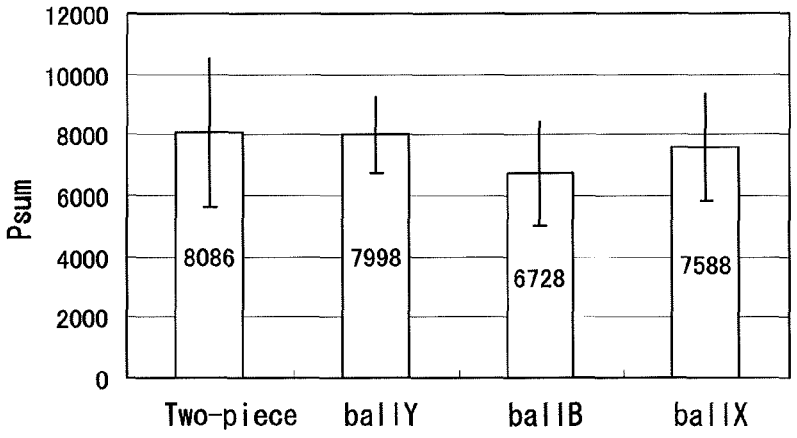
FIG. 26 is a bar graph showing an example of a measured result of an increasing amount Psum in each of several different balls.

[Test 12] Verification by Professional Golf Player or Advanced Level Golf Player A professional golf player P3 carried out measurement in the same manner as in the test 6. As the functional evaluation results by the golf player P3, four kinds of hit feelings were equal. A sampling frequency for pressure measurement was set to 1000 Hz. FIG. 26 shows measured results (average value) of an increasing amount Psum by the golf player P3. The result is different from the other golf players' results in that the result of the two-piece ball is close to those of the other balls.

Table 7 shows results (P value) of significant difference test in the test 12. As shown in Table 7, the significant difference is not recognized in any of the combinations. These results highly correlate with the functional evaluation by the golf player P3.

TABLE 7

| Results of significant difference test (P value) | | | |
|---|---|---|---|
| Two-piece ball | ball Y | ball B | ball X |
| Two-piece ball | 47.3% | 17.0% | 36.2% |
| ball Y | | 11.0% | 34.3% |
| ball B | | | 23.1% |
| ball X | | | |

Figure 27:
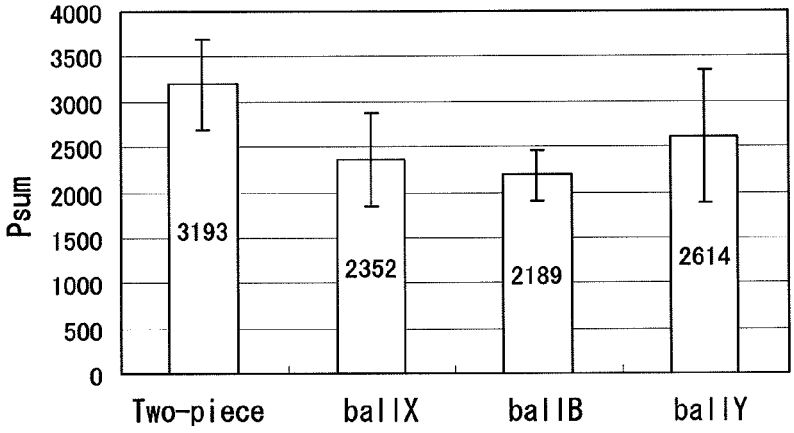
FIG. 27 is a bar graph showing an example of a measured result of an increasing amount Psum in each of several different balls.

[Test 13] Verification by Professional Golf Player or Advanced Level Golf Player An amateur golf player A5 carried out measurement in the same manner as in the test 6. As the functional evaluation results by the golf player A5, the balls are the ball B as the first, the ball X as the second, the ball Y as the third, and the two-piece ball as the fourth in an order from the softest ball. A sampling frequency for pressure measurement was set to 1000 Hz. FIG. 27 shows measured results (average value) of an increasing amount Psum by the golf player A5. The result highly correlate with the functional evaluation by the golf player A5.

Table 8 shows results (P value) of significant difference test in the test 13. As shown in Table 8, the significant difference is recognized between the ball X and the two-piece ball and between the ball B and the two-piece ball. The result highly correlates with the functional evaluation of the golf player A5.

TABLE 8

| Results of significant difference test (P value) | | | |
|---|---|---|---|
| Two-piece ball | ball X | ball B | ball Y |
| Two-piece ball | 1.5% | 0.4% | 9.4% |
| ball X | | 27.6% | 26.6% |
| ball B | | | 13.9% |
| ball Y | | | |

Figure 28:
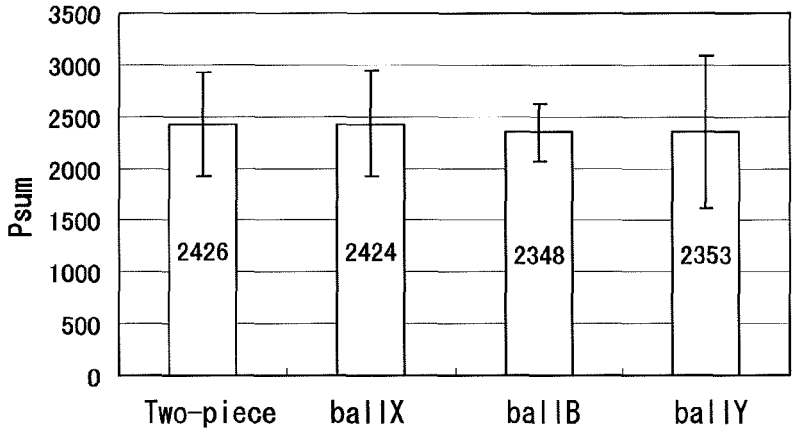
FIG. 28 is a bar graph showing an example of a measured result of an increasing amount Psum in each of several different balls.

[Test 14] Verification by Professional Golf Player or Advanced Level Golf Player An amateur golf player A6 carried out measurement in the same manner as in the test 6. As the functional evaluation results by the golf player A6, four kinds of hit feelings were equal. A sampling frequency of pressure measurement was set to 1000 Hz. FIG. 28 shows measured results (average value) of an increasing amount Psum by the golf player A6. The result highly correlates with the functional evaluation by the golf player A6.

Table 9 shows results (P value) of significant difference test in the test 14. As shown in Table 9, the significant difference is not recognized in any of the combinations. These results highly correlate with the functional evaluation by the golf player A6.

TABLE 9

| Results of significant difference test (P value) | | | |
|---|---|---|---|
| Two-piece ball | ball X | ball B | ball Y |
| Two-piece ball | 49.5% | 33.3% | 38.2% |
| ball X | | 33.9% | 38.7% |
| ball B | | | 49.0% |
| ball Y | | | |

Comparative Example

Figure 29:
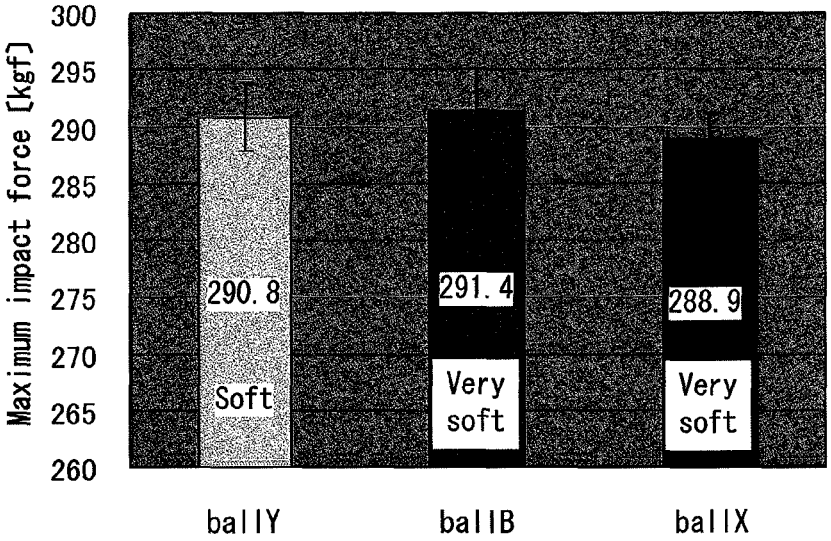
FIG. 29 is a bar graph showing an example of a measured result of the maximum impact force in each of several different balls.

An impact force at the time of hitting was measured for the ball B, the ball X, and the ball Y. An acceleration pickup was attached to a back side of a face of a golf club. The golf club was mounted to a swing robot. The same wedge as that in the test by the human being was used as the golf club. A test of an impact force was carried out with a hitting point set constant. Values (average values) of the obtained maximum impact force are shown by a bar graph of FIG. 29.

The ball B and the ball X obtain the most functional evaluations in which the balls are very soft. On the other hand, the ball Y obtains the most functional evaluations in which the ball Y is slightly harder than ball B and the ball X. The evaluation result of FIG. 29 correlates with the functional evaluation.

Table 10 shows results (P value) of significant difference test in the comparative example. As shown in Table 10, the significant difference is not recognized in any of the combinations. These results correlate with the functional evaluation.

TABLE 10

| Results of significant difference test (P value) | | |
|---|---|---|
| ball Y | ball B | ball X |
| ball Y | 78.1% | 28.4% |
| ball B | | 23.8% |
| ball X | | |

The following Table 11 shows specifications and evaluation results for a part of the golf ball.

TABLE 11 specifications and evaluation results of balls

| | | | Ball X | Commercial item A (ball A) | Commercial item B (ball B) | Ball Y |
|---|---|---|---|---|---|---|
| Ball | SCH | Average | 2.35 | 2.35 | 2.20 | 2.35 |
| | | σ | 0.022 | 0.043 | 0.040 | 0.017 |
| | Weight | Average | 45.577 | 45.703 | 45.368 | 45.490 |
| | (g) | σ | 0.112 | 0.068 | 0.052 | 0.088 |
| | Diameter | Average | 1.6861 | 1.6830 | 1.6830 | 1.6841 |
| | (inch) | σ | 0.0016 | 0.0007 | 0.0004 | 0.0011 |
| Cover | Thickness | | 0.5 | 0.85 | 1.05 | 0.4 |
| | Material hardness (D) | | 32 | 46 | 49 | 38 |
| Intermediate layer | Thickness | | 1.0 | 0.9 | 1.2 | 1.0 |
| | Material hardness (D) | | 65 | 66 | 66 | 65 |
| Inner side intermediate layer | Thickness | | — | — | 1.6 | — |
| | Material hardness (D) | | — | — | 59 | — |
| Core | SCH | | 2.75 | 2.70 | 3.40 | 2.75 |
| | Hardness distribution | Center | 40 | 33 | 34 | 40 |
| | | 5 mm | 48 | 36 | 41 | 48 |
| | | 10 mm | 48 | 45 | 43 | 48 |
| | | 15 mm | 52 | 55 | 49 | 52 |
| | | Surface | 59 | 61 | 54 | 59 |
| Structure | | | One-layer core Two-layer cover | One-layer core Two-layer cover | Two-layer core Two-layer cover | One-layer core Three-layer cover |

Note)
Twelve pieces were measured for each ball.

In Table 11, "SCH" means an amount of compressive deformation. The amount of compressive deformation is a deformation amount of a ball when the ball is compressively deformed at a predetermined rate to a state where a predetermined end load is applied from a state where a predetermined initial load is applied.

As described above, the hit feeling may be different in each person. The evaluation results (compressive deformation amount) of Table 11 and the hit feeling do not necessarily correlate with each other. In the examples described above, the correlation between the hit feeling and the numerical values of the evaluation results is high. From these evaluation results, the advantages of the present invention are apparent.

The method explained above can be applied to the evaluation of the hit feeling in all sport hitting tools.

The description hereinabove is merely for an illustrative example, and various modifications can be made in the scope not to depart from the principles of the present invention.

What is claimed is:

1. A method for quantitatively evaluating hit feeling of a sport hitting tool, the method comprising:

using a sensor to measure forces F acting between a swing subject and the sport hitting tool or specific directional components F1 thereof to obtain values of the forces F or the components F1 generated by impact for a first time period;

sending readings from the sensor to a computer;

deciding the hit feeling based on a correlation between the hit feeling and the value of the force F or the component F1 by a summation of forces or the components during the first period or a rate of change in the forces or the components during the first time period.

2. The method according to claim 1, wherein the values of the forces F or the components F1 in a specified period Z12 between a time T1 and a time T2 after the impact are obtained in time series, and the hit feeling is evaluated based on an integrated value Sf of the forces F or the components F1 in the specified period Z12.

3. The method according to claim 1, wherein the values of the forces F or the components F1 in a specified period Z12 between a time T1 and a time T2 after the impact are obtained in time series, and the hit feeling is evaluated based on a rate Rd of change of the forces F or the components F1 in the specified period Z12.

4. The method according to claim 2, wherein the time T1 is a time Tmin when the forces F or the components F1 reach the minimum in a predetermined period.

5. The method according to claim 4, wherein when a time when the forces F or the components F1 reach the maximum between an impact time Tp and a time after 50 msec from the impact time Tp is defined as Tmax, the time Tmin is a time when the forces F or the components F1 reach the minimum between the impact time Tp and the time Tmax.

6. The method according to claim 1, wherein the measuring means M1 includes a pressure sensor provided between the swing subject and the sport hitting tool, and a setting position of the pressure sensor is determined based on comparison of a distribution of the forces F or the components F1 in a practice swing with a distribution of the forces F or the components F1 in actual hitting.

7. The method according to claim 1, wherein the measured data is sifted through in consideration of uniformity of a swing speed and/or uniformity of a hitting point.

8. The method according to claim 2, wherein the specified period Z12 is equal to or less than 100 msec.

9. The method according to claim 1, further comprising the steps of:

measuring the force F or the component F1 in actual hitting and the force F or the component F1 in a practice swing; and selecting a position at which a difference between the force F or the component F1 in the actual hitting and the force F or the component F1 in the practice swing is equal to or greater than a threshold value A, as a measured area.

10. The method according to claim 1, further comprising the step of selecting the measured data, wherein the step of selecting the measured data includes the steps of:

determining a threshold value B as a range of variation in a head speed;

determining a threshold value C as a range of variation in a hitting point; and selecting the measured data based on the threshold value B and the threshold value C.

11. The method according to claim 1, further comprising the step of selecting the measured data, wherein the step of selecting the measured data includes the steps of:

determining a threshold value D; and selecting the measured data when the minimum value of the forces F or the components F1 at times later than the impact is equal to or less than the threshold value D.

* * * * *